United States Patent [19]

Ottenheimer et al.

[11] 4,383,661

[45] May 17, 1983

[54] FLIGHT CONTROL SYSTEM FOR A REMOTE-CONTROLLED MISSILE

[75] Inventors: Philippe Ottenheimer; Pierre Haon, both of Paris, France

[73] Assignee: Thomson-CSF, Paris, France

[21] Appl. No.: 162,303

[22] Filed: Jun. 23, 1980

[30] Foreign Application Priority Data

Jun. 27, 1979 [FR] France ..... 79 16559

[51] Int. Cl.[3] ..... F41G 7/28

[52] U.S. Cl. ..... 244/3.14

[58] Field of Search ..... 244/3.14

[56] References Cited

U.S. PATENT DOCUMENTS

| | | | |
|---|---|---|---|
| 2,352,308 | 6/1944 | Bailey | 244/3.14 |
| 2,603,434 | 7/1952 | Merrill | 244/3.14 |
| 3,156,435 | 11/1964 | Norton et al. | 244/3.14 |
| 3,168,264 | 2/1965 | Sendles | 244/3.14 |
| 3,360,214 | 12/1967 | Stcherbatcheff | 244/3.14 |
| 3,450,373 | 6/1969 | Richards | 244/3.14 |
| 3,998,406 | 12/1976 | Smith et al. | 244/3.14 |
| 4,097,007 | 6/1978 | Fagan et al. | 244/3.14 |

FOREIGN PATENT DOCUMENTS

| | | |
|---|---|---|
| 1325343 | 3/1963 | France . |
| 2129948 | 11/1972 | France . |

*Primary Examiner*—Charles T. Jordan

*Attorney, Agent, or Firm*—Karl F. Ross

[57] ABSTRACT

A ground station forming part of a system for controlling the flight of a missile comprises two cascaded computers, the first of these computers generating guidance instructions on the basis of initially available data while the second computer converts these instructions into control signals transmitted to the missile. A receiver aboard the missile translates these control signals into operating commands for missile-borne actuators affecting its course, e.g. motors controlling yaw and pitch through the positioning of aerodynamic surfaces; the responses of the actuators to the operating commands are monitored by negative-feedback loops including error-correcting networks.

5 Claims, 4 Drawing Figures

FLIGHT CONTROL SYSTEM FOR A REMOTE-CONTROLLED MISSILE

FIELD OF THE INVENTION

Our present invention relates to a flight-control system for a remote-controlled missile.

BACKGROUND OF THE INVENTION

A certain number of operations are necessary before the actual launching of a missile to insure a fulfillment of its mission, i.e. to let the missile reach the target to which it is directed or at least approach it sufficiently to enable its destruction to take place under optimum conditions.

The operations of bringing the missile from its launch point to the target are subdivided into those relating to guidance and those relating to the actual control.

By definition the guidance function calculates the lateral accelerations which have to be performed by the missile, whereas the control function relates to the carrying out of these instructions by the missile. We shall particularly refer hereinafter to guidance instructions relating to controlled lateral accelerations and to control instructions relating to the positioning of the actuators aboard the missile.

Within the scope of the present invention the term actuator is understood to mean any missile-borne mechanical device controllable to vary the forces exerted on the missile, thereby affecting its course. The actuators can, for example, be aerodynamic control surfaces acting with amplification by being placed at the front or rear of the missile, or acting without aerodynamic amplification if they are placed in the vicinity of the center of gravity. They also could be jets of gas perpendicular to the missile axis which, when positioned either at the front or at the rear, may also act with amplification in jet-propulsion or jet-deflection systems.

Our invention is particularly applicable to a control system in which the lateral acceleration imparted to the center of gravity of the missile has a completely or partly aerodynamic origin, i.e. results from the action of the relative velocity of the surrounding air. These accelerations are controlled by the aforementioned actuators.

OBJECT OF THE INVENTION

The object of our invention is to provide a control system for a missile which has no missile-borne autopilot whereby the construction of the missile is simplified, its operation is made easier and consequently its costs are reduced.

SUMMARY OF THE INVENTION

A system for controlling the flight of a missile in accordance with our present invention comprises a ground section which includes a first computer supplying guidance instructions, on the basis of initial data available at the time the missile is launched, to a second computer converting these instructions into control signals for the actuators aboard the missile. These control signals are sent out by transmission means connected to the second computer and are detected by missile-borne receiving means in radio communication therewith; the detected control signals are translated by circuit means aboard the missile, connected to the receiving means, into operating commands for the actuators affecting the missile's course, e.g. one or more motors controlling the positioning of aerodynamic surfaces forming part of these actuators.

BRIEF DESCRIPTION OF THE DRAWING

The above and other features of our invention will be described in greater detail hereinafter with reference to the attached drawing in which.

DETAILED DESCRIPTION

Figure 1:
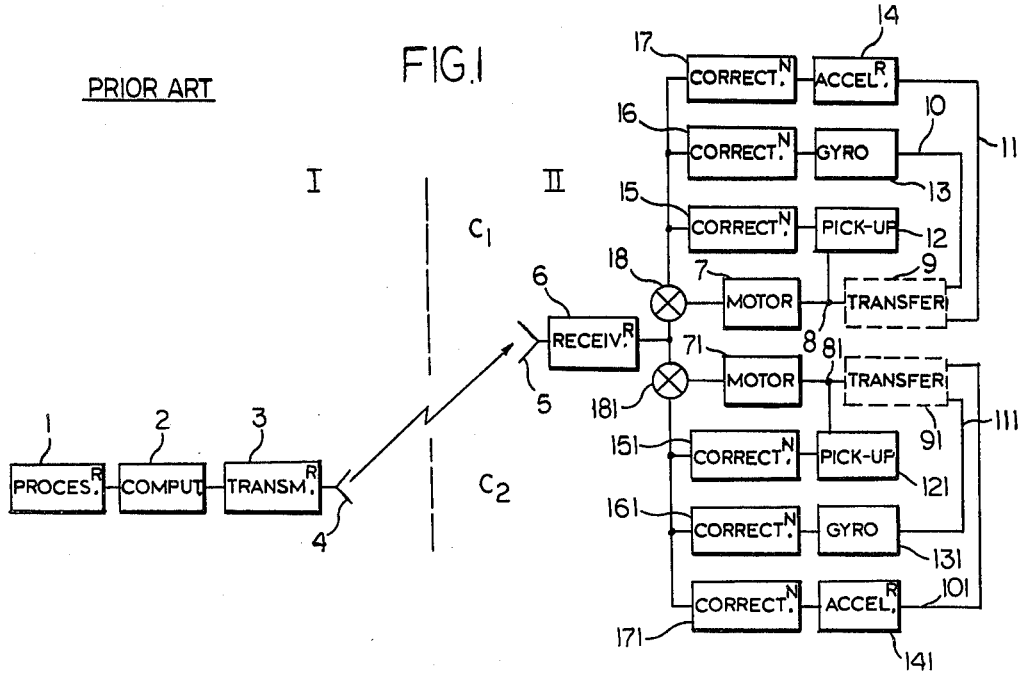
PRIOR ART FIG.1
FIG. 1 is a block diagram of a prior-art missile-control system.

FIG. 1 shows a block diagram of a conventional missile-control system with a guidance section I on the ground and with a missile-borne autopilot II which compares instructions defining the desired movement of the missile and the movement which it actually carries out as measured by a pick-up. The error determined by this comparison makes it possible to correct the instruction given to the missile. The ground section I comprises a device that processes the deviation between the flight path of the missile and the theoretical trajectory which it has to follow on the basis of the adopted guidance mode. This deviation processor is followed by a computer 2 which generates guidance instructions in acceleration, yaw and pitch and feeds them to a remote-control transmitter 3 having an antenna 4.

The autopilot II aboard the missile receives commands from the ground by means of an antenna 5 connected to a remote-control receiver 6. A yaw-control channel $C_1$ and a pitch-control channel $C_2$ are connected to the receiver. The yaw-control channel $C_1$ is constituted by a loop incorporating a motor 7 with its supply system, controlling the yaw actuator (not shown). A lead 8 carries the response of the yaw actuator driven by motor 7 while a transfer cell 9 emits on leads 10 and 11 respective data concerning the angular velocity and the lateral acceleration of a yawing motion executed by the missile. The data are respectively applied to a gyro 13 and an accelerometer 14, associated with respective correction networks 16, 17 included in velocity and acceleration negative-feedback loops. The response 8 of the yaw actuator is measured by a pick-up 12 followed by a correction network 15 in a positional feedback loop. The yawing loop described hereinbefore is connected to the output of receiver 6 by way of an add-subtract counter 18. However, it should be noted that certain systems have only one of the two gyro and accelerometer loops.

The pitch-control loop $C_2$, which is identical to the yaw-control loop $C_1$ described hereinbefore, is connected to the output of receiver 6 by way of an add-subtract counter 181. All the other circuits of loop $C_2$ carry the same references as the corresponding circuits of loop $C_1$ supplemented by a "1" in the position of the lowest digit.

From the foregoing description of the prior art it can be seen that the manufacture of a missile which has to contain an autopilot is complicated in regard to its control and functioning. In addition, there are also on-site controls, all of which contributes to increasing costs.

Figure 2:
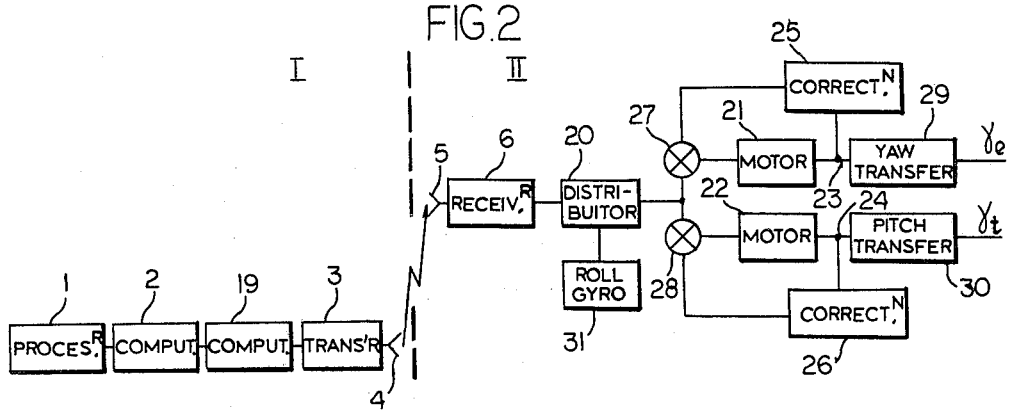
FIG. 2 is a block diagram of a control system according to the invention.

FIG. 2 shows a control system according to our invention with a ground section I which includes the components 1–4 described with reference to FIG. 1. Its guidance computer 2 is connected to a second computer 19 in cascade therewith which processes the control instructions designed to bring the missile actuators into the appropriate position. These control instructions are sent out by the transmitter 3 equipped with antenna 4.

The missile-borne part II of the control system includes the aforedescribed remote-control receiver 6 equipped with antenna 5. The receiver 6 is connected to a circuit 20, called a resolver and instruction distributor, which is connected to a roll gyroscope 31 detecting the missile roll when the missile is not roll-stabilized. By way of subtraction circuits 27 and 28 the instruction distributor 20 is connected to respective actuator circuits 21 and 22 responsive to the commands processed on the ground in computer 19. Leads 23 and 24 respectively carry the responses from the actuators which are transmitted on the one hand to a pair of error-correcting networks 25, 26, included in negative-feedback loops closed through the subtraction circuits 27, 28, and on the other hand to circuits 29 and 39 generating yaw and pitch transfer functions $\gamma_l$ and $\gamma_t$.

The control system of FIG. 2 functions as follows. When the missile is launched, angular-deviation measurements are made by processor 1 and computer 2 generates on the basis of the measured deviations the yaw and pitch guidance instructions in the form of acceleration commands that are transformed in computer 19 into control instructions. To this end the computer 19 has all the data necessary for calculating with a sufficient accuracy the positions to be given to the actuators enabling the desired acceleration operations to be performed. Depending on the particular case, the initial data can consist of the thrust profile of the missile's engines, the atmospheric conditions (pressure, temperature, wind) as well as its aerodynamic parameters, its mass, its inertia values as a function of time, the variation of its center of gravity and the transfer functions of the actuators. All the data are fed into computer 19, which can be a microprocessor programmed in an appropriate manner in accordance with the missile flight equations. Computer 2 generating the guidance instructions, which can for example be an alignment guidance, functions on the basis of angular-deviation data measured in circuit 1, angular velocities in elevation and azimuth of the line of sight supplied by the gyro box, the lowering correction due to gravity and the distance of the missile measured or calculated on the basis of its stored velocity profile.

The controlled-acceleration or guidance instructions supplied by computer 2 are converted by computer 19 into signals representing deflection angles of the control surfaces, for example in yaw and pitch control, calculated in a co-ordinate system independent of the missile roll. In ground section I the remote-control system 3, 4 then sends out, for example on a carrier of approximately 1000 MHz, a repeat message including the address of the missile and the various instructions to be transmitted to it. Thus, the ground transmitter 3 is not allocated to one missile; in the overall weapons system to which the present invention relates, a certain number of missiles can be launched simultaneously and it must be possible to distinguish them. The transmitted instructions include those for changing the direction of aerodynamic control surfaces, when the missile is equipped with such surfaces, or more generally actuator-positioning commands. As stated hereinbefore, the term actuator is intended to mean any device exerting a mechanical stress on the basis of a generally low-level control signal which serves to transmit to the missile the commands generated at the ground section I. The commands are generally transmitted in the form of binary words. The positioning instructions for the control surfaces are calculated in computer 19 independently of the missile roll, i.e. in a ground-oriented co-ordinate system. In order to be applicable to the missile, these instructions must be processed in a co-ordinate system tied to the missile position and taking account of the rotation of the missile about its longitudinal axis. Under these conditions the control-surface-deflection instructions are applied to the actuator circuits 21 and 22 by instruction distributor 20, which is a calculator performing the transpositions necessary for passing from the ground axes to the missile axes. The two circuits 21 and 22 respectively include yaw-control and pitch-control motors with their supply systems, amplifiers and a power stage. These motors are inserted in respective negative-feedback loops, incorporating the correction networks 25, 26 and the subtraction circuits 27, 28, which monitor the correct execution of the yaw and pitch instructions $\gamma_l$ and $\gamma_t$.

Figure 3:
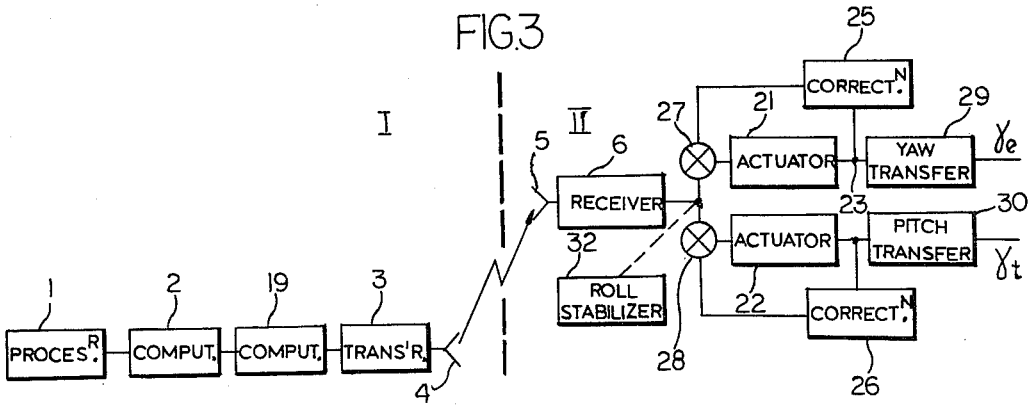
FIG. 3 is a block diagram of a modification of the system of FIG. 2 designed for a missile stabilized in roll.

FIG. 3 shows the control system according to the invention modified for use in a roll-stabilized missile. The ground part I is identical to that of FIG. 2. The missile-borne part II is simplified, the resolver and instruction distributor 20 and the roll gyro being omitted. However, a roll stabilizer known per se is carried by the missile and has been indicated in FIG. 3 by reference numeral 32.

Figure 4:
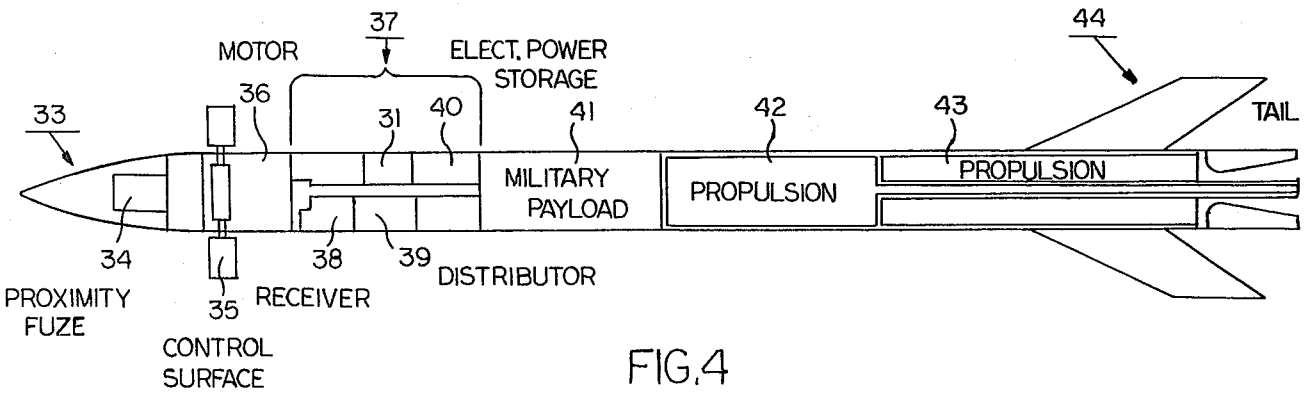
FIG. 4 is a diagrammatic view of a missile controlled by a system according to the invention.

FIG. 4 shows a missile which is controlled by the system according to the invention and which, unlike known missiles, has no autopilot to simplify its design. The forward part 33 of the missile carries a proximity fuze 34, together with control surfaces 35 and a motor 36, whereas the following part 37 carries a remote-control receiver 38, an instruction distributor 39, the roll gyro 31 and an electric power store 40. Another part 41 contains the military payload, parts 42 and 43 carry the propulsion devices and a part 44 is a tail assembly which can incorporate the remote-control receiving antenna.

The relative arrangement of the various missile components shown in FIG. 4 is not part of our invention but has been shown as a way of balancing the masses of the components to insure the in-flight stability of the missile.

We claim:

1. A system for controlling the flight of a missile provided with actuators affecting its course, comprising:

a ground section including a first computer supplying guidance instructions on the basis of initial data available at launching time, a second computer receiving said guidance instructions from said first computer and converting same into control signals for the actuators aboard the missile, and transmission means connected to said second computer for sending out said control signals;

receiving means aboard the missile in radio communication with said transmission means for detecting said control signals; and circuit means aboard the missile connected to said receiving means for translating said control signals into operating commands for said actuators.

2. A system as defined in claim 1 wherein said circuit means comprises a negative-feedback loop including an error-correcting network and a subtractor.

3. A system as defined in claim 1 or 2 wherein said circuit means includes a distributor separating said control signals into yaw-control and pitch-control signals.

4. A system as defined in claim 3 wherein said distributor comprises a resolver connected to a roll gyro for adapting said yaw-control and pitch-control signals to a co-ordinate system tied to the position of the missile.

5. A system as defined in claim 1 or 2 wherein said actuators have aerodynamic surfaces positionable by motor means responsive to said operating commands.

* * * * *